US007034218B1

(12) United States Patent
Lazarus et al.

(10) Patent No.: US 7,034,218 B1
(45) Date of Patent: Apr. 25, 2006

(54) POINT SOURCE CONTACT TRANSDUCER

(76) Inventors: Arnold M. Lazarus, 81 Colton Ave., Sayville, NY (US) 11782; Yu Hei S. Wai, 2282 Hastings Dr., Belmont, CA (US) 94002

( * ) Notice: Subject to any disclaimer, the term of this patent is extended or adjusted under 35 U.S.C. 154(b) by 186 days.

(21) Appl. No.: 10/701,746

(22) Filed: Nov. 5, 2003

Related U.S. Application Data

(60) Provisional application No. 60/424,296, filed on Nov. 6, 2002.

(51) Int. Cl.
*G10H 3/00* (2006.01)

(52) U.S. Cl. ..... 84/723; 84/726

(58) Field of Classification Search ..... 84/723, 84/735, 622, 659, 730, 731, 294; 310/334; 381/152, 353
See application file for complete search history.

(56) References Cited

U.S. PATENT DOCUMENTS 3,624,264 A * 11/1971 Lazarus ..... 84/730
4,030,396 A * 6/1977 Mariner ..... 84/731
4,218,951 A * 8/1980 Tressel ..... 84/294
4,310,730 A * 1/1982 Aaroe ..... 381/152
4,701,658 A 10/1987 Ringermacher et al. .... 310/334
5,206,449 A 4/1993 McClish ..... 84/723
6,448,488 B1 9/2002 Ekhaus et al. ..... 84/735
2004/0184631 A1* 9/2004 Hosler ..... 381/353

* cited by examiner

*Primary Examiner*—David Martin
*Assistant Examiner*—Jianchun Qin
(74) *Attorney, Agent, or Firm*—Collard & Roe, P.C.

(57) ABSTRACT

A transducer for use with a musical instrument to transmit vibrations from the instrument to an amplifier has a weight, at least one sensor connected to the weight, an insulating layer covering the weight and the sensor, a substrate layer covering the insulating layer, an attachment device for mounting the transducer to the musical instrument and a cable mounted to the bas for connecting the transducer to an amplifier. One conductor of the cable is mounted to the weight and a ground shield of the cable is connected to the substrate. The transducer translates surface vibrations of the instrument into electrical signals that can then be amplified or recorded. The transducer has superior tonal qualities.

21 Claims, 5 Drawing Sheets

POINT SOURCE CONTACT TRANSDUCER

CROSS-REFERENCE TO RELATED APPLICATIONS

This application is based on Provisional Application No. 60/424,296, filed on Nov. 6, 2002.

BACKGROUND OF THE INVENTION

1. Field of the Invention

This invention relates to a pickup or transducer for musical instruments. In particular, the invention relates to a pickup for a guitar comprising one or more piezo-electric crystals mounted within a framework for detecting sound from the guitar and transmitting it via a cable to an amplifier.

2. The Prior Art

It is often desired to amplify the sounds made by an acoustic guitar, without altering the quality of sound made by the guitar. A common way to do this is to attach a transducer, or pickup, to the guitar. The pickup detects the sounds of the guitar and transmits the sounds to an amplifier via a cable. The pickup is typically made with piezoelectric crystals, such as that described in U.S. Pat. No. 3,624,264 to Lazarus, the disclosure of which is herein incorporated by reference.

The drawback to this standard pickup is that the pickup must be mounted in a very precise manner on the guitar. Any deviation from a perfect mounting position will cause the vibrations detected by the crystals to cancel each other out and the sound will be distorted. The precise mounting position is determined by the guitar's "sweet-spot" and typically resides on the right side of the guitar under the bridge (or on the left side for left-handed guitars). This spot is very small and difficult to detect in a precise manner. In addition, variations in the position of the piezo crystals during manufacturing further increases the difficulties in locating the optimum position for the pickup, resulting in very poor repeatability from guitar to guitar, and from pickup to pickup. This constitutes the major disadvantage that has prevented its application on a high volume or OEM basis. Consequently, many pickups are mounted incorrectly and do not transmit the sound properly.

U.S. Pat. No. 6,448,488 to Elhaus refers to a very complicated method of achieving a similar output signal using three crystals mounted at different points around the bridge of the guitar, each crystal being representative of a different axis. These are combined and then electronically processed to obtain a potentially dephased signal. U.S. Pat. No. 5,206,449 to McClish uses two transducers to provide a dephased signal.

Transducers that employ large sensing areas, continuous sensors or multiple sensors that are not isolated are especially susceptible to severe time, phase and frequency errors. These transducers are ubiquitous in the marketplace. However, they carry intrinsic fundamental phase and time delay problems that "smear" the sound of the pickup and cannot be overcome or compensated for with additional electronics or in combination with additional sensors or sensor types.

The common major defects of the current transducers are as follows:

1. Difficulty in setup: the transducer requires a "unique" location to compensate for various phase, time and amplitude errors. The transducer location is not repeatable and requires constant adjustment to get a good tone. The difficulty in setup also prevents such a transducer from being installed by the instrument manufacturer to achieve a uniform sound quality, unit to unit. A fundamental characteristic of this transducer defect is that a small change in location, i.e., 0.005", would lead to drastic changes to the tonal qualities.

2. Unstable tonal response: different playing styles yield widely different tonal qualities. This is the result of the interaction between the time and frequency components in the signal. One fundamental characteristic of this defect is that a particular combination of instrument and a particular transducer may sound acceptable for one playing style, i.e., finger style, but would sound completely unacceptable for another style, i.e., strumming. The common solutions being offered on the market are "blender" systems combining multiple transducers or microphones as an attempt to compensate for the unstable tonal response of the primary pickup. Although quite popular, these systems rarely achieve completely acceptable tonal qualities for all situations.

3. Insufficient frequency flatness and bandwidth: this is most evident given the increase in usage of more frequency equalization. Some models offer graphic equalizers on the side of guitars in an attempt to compensate for poor frequency response of the transducer. One fundamental characteristic of such a system defect is the very poor sound quality when the controls are set flat.

SUMMARY OF THE INVENTION

It is therefore an object of the invention to provide a guitar pickup that is simple to mount correctly and which will transmit clear and accurate sounds from the guitar to the amplifier.

It is another object of the invention to provide a pickup that is small, and simple and inexpensive to manufacture.

These and other objects are accomplished by a guitar pickup comprising a cubic or other shaped weight, and one or more sensors which are preferably piezo-electric crystals. Other types of sensors could also be used, i.e., piezoelectric film, magnetic sensors, strain gauge sensors, electret sensors, resistive sensors, and capacitive sensors. In a three-crystal version, each crystal is mounted on a different axis of the weight, so that the vector sum of the three crystals accurately reproduces the vibrations of the x, y and z-axes.

On top of the weight and crystals, there is an insulating material such as a gel, or an air gap. The pickup is enclosed by a conductive shell and is used to shield the detector from external electrical interference. The device according to the invention produces a superior, relatively undistorted, sound as the resulting signal is a composite wave form whose several contributing components are produced independent of each other and whose output signals equally determine the frequencies and their amplitudes produced along three orthogonal axes. The composite waveform is the result of monitoring and combining frequency variations produced in each of three dimensions by the instrument to which the device is attached.

The pickup according to the invention works as an accelerometer, detecting acceleration in all three axes. In other words, the device functions by combining the electrical signals from each of three independent vibrating sources whose principal axes are orthogonal to each other along each of three Cartesian axis by detecting continuous variations in acceleration, velocity and/or spatial measurements along their respective axes. These variations are produced when the instrument is being played. The electrical signal produced by each of the three vibrating sources is connected by a separate conductor. The three signals are oscillations produced along a single axis independent of each other. The three signals are combined to produce a composite signal. Each component of the composite signal is a waveform produced independently of the other two signal sources and independently of forces which generate a signal in the other two vibrating sources. The combining means is the connection of a conductor from each of the three vibrating sources to a point from which the composite signal is communicated by a fourth conductor to a preamplifier. Each of the vibrating sources together with the electrical signal produced by each, act as an accelerometer. Since the input to each vibrating source originates at the same contact point on the instrument or equidistant from it and since the orientation of each vibrating source detects variations only in one axis, the signal produced by each is unaffected by any variations produced perpendicular to that axis. The vibrating sources are typically flat crystals whose orientation relative to each other, when mounted, is orthogonal.

In use, vibrations in the musical instrument are transmitted from the musical instrument to the sensor or sensors, which generate a signal between the conductor connected to the conductive layer and the conductor connected to the sensor in proportion so the vibrations create a signal that is amplified by a signal processing device.

In a preferred embodiment, the invention provides for a single point contact that further minimizes mechanical phase interference at the pickup contact point. The symmetrical weight is preferably mounted to the guitar via the point source contact to allow the pickup to be mounted to a guitar or other instrument in a precise manner. Preferably, the weight is mounted so that one principal diagonal of the cube is perpendicular to a surface of the instrument. A contact is mounted on each of the three faces of the cube nearest the surface of the instrument. The crystal structures preferably used to detect the variations are preferably flat shaped and are attached to the faces of the cube equidistant from the contact point of the cube to the instrument. The conductors affixed to each of the three crystals are attached at equal distance from the contact point. This arrangement conducts the vibrations from the point source contact at each of the three elements simultaneously and without additional phase or time delay error.

While it is important that the mechanical features of the device be as symmetrical as possible, this does not imply a strict cubic approach. For example, the point source contact or "pin" could also be attached to one of the transducer faces. The pin is embedded in the desired mounting place on the guitar to guarantee optimum sound transmission. The "pin" can be a small raised arc of any height.

Alternatively, the transducer could be directly mounted to the guitar or other instrument via adhesive on one of its faces. The device according to the invention works equally well with any type of attachment device, i.e., fasteners such as screws, adhesives, either permanent or temporary, wax, putty, a press-fit, clamps (spring, clip, snap, sandwich), or it can be embedded or encapsulated in the instrument.

A coaxial cable is soldered onto the device to connect the device to an amplifier. The center conductor of the cable is soldered to the weight and the ground shield of the cable is soldered to the outer shell. This connection now acts as the ground reference point for the transducer system. The other end of the cable is connected to a preamplifier or can be connected directly to an instrument amplifier.

The device is generally mounted directly to the bridge or bridge plate of the instrument, at its acceptable operating area, or "sweet spot". The sweet spot is the area on the instrument in which the transducer picks up the most balanced sound from the instrument. This invention creates more usable sweet spots than with other pickups, so the pickup of the invention is easier to mount. In use, the crystal or crystals detect the sounds created by the instrument and transmit the sounds to the amplifier through the cable.

In an alternative embodiment of the device, the pickup can be mounted on the underside of the guitar surface via a mounting bracket that attaches to the underside of the guitar.

In another alternative embodiment, the contact pin can be replaced with a contact plate, with the plate mounted symmetrically to each of the piezoelectric crystals. The mounting plate attaches to the inside or outside surfaces of a guitar or instrument.

In another alternative embodiment of the device, there is only a single crystal, which works along a single axis. To implement this transducer, all that is needed is a small contact area, such as a pin, clip, or raised surface, adhesive and a sensor element that is located symmetrically to the axis of the contact point. The sensor element is located directly on top of the contact point along with a symmetrical substrate, cube and shield. With this embodiment, there is no radial directionality to the transducer. Small adjustments to the placement yields small changes in the frequency balance but without evidence of phase or time induced cancellations.

In yet another alternative embodiment, the transducer comprises three separate weights or cubes, each cube having a single sensor. Each cube is mounted on an essentially Y-shaped plate, with each cube mounted radially symmetric from the other. Each arm of the "Y" is folded upwards at an angle of approximately 45° from the horizontal. This version of the transducer simplifies and reduces the manufacturing cost of the transducer because it is more accepting to manufacturing tolerances, reduces the assembly steps and is easier to make.

A variation of this embodiment consists of a flat substrate on which 3 separate angled arms are attached. The weights are then attached to the arms, and the contact is mounted to the substrate.

The invention also comprises a method for creating a point source contact transducer for detecting surface vibrations and transmitting the vibrations from a musical instrument to one or more sensors to generate a final output signal that has natural tonal qualities of the instrument. The method comprises the following steps:

- forming a transducer having a conductive substrate,
- connecting the substrate to at least one sensor symmetric to a normal axis of the substrate;
- connecting the sensor to at least one weight;
- covering the substrate, sensor, and weight with an insulating layer or air gap;
- covering the insulating layer or air gap with a conductive layer shielding the transducer from external EMI interference by connecting the conductive layer to the substrate;
- connecting a coaxial cable center conductor of a coaxial cable to the weight;
- connecting a coaxial cable shield of the coaxial cable to the substrate to form a reference ground of the transducer;
- forming a single point contact area on the transducer;
- placing the transducer via the single point contact area on a surface of the instrument;
- detecting surface vibrations of the instrument via the sensor through the single point contact area; and
- transmitting the vibrations to an amplifier through the coaxial cable.

In a preferred variation of the method, there are at least two sensors that are mounted on the substrate such that the sensors are placed radially symmetric to the single point contact area. The sensors are also connected electrically in parallel so that the outputs are proportionally summed and converted to a sum signal to obtain a true representative of natural tonal qualities of the instrument.

While a guitar is a commonly employed instrument with respect to the use of pickups, the device according to the invention will work with any musical instrument that has vibrating surfaces, including violins, violas, cellos, mandolins, dulcimers, pianos, harps and wind instruments.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
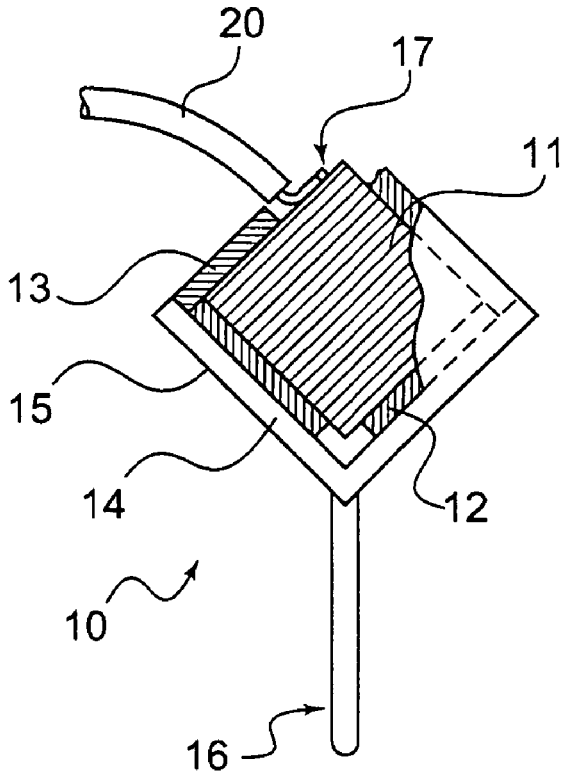
FIG. 1 shows a side view of one embodiment of the device according to the invention, with the layers cut away for illustration.
Figure 2:
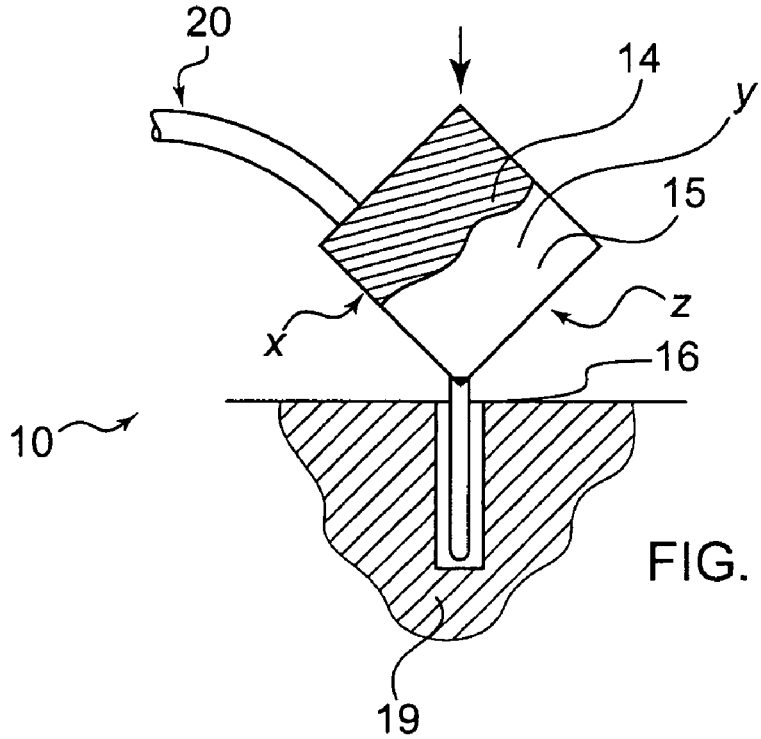
FIG. 2 shows a side view of the device of FIG. 1 mounted in an instrument.

Referring now in detail to the drawings, FIGS. 1 and 2 show the device 10 according to the invention. Device 10 comprises a cube-shaped weight 11, onto which three sensors in the form of piezoelectric crystals 12 are mounted, each crystal in a different axis. Each crystal 12 is connected in parallel with the other crystals 12. Weight 11 is preferably made of brass, but other materials such as lead or tungsten could also be used. Over the crystals 12 and cube 11 is an insulating cover layer 13, which is made of insulating material such as gel, and/or an air gap. On top of insulating cover layer 13 is a conductive layer 14, which is made of steel or brass, but other conductive materials could also be used. A mounting pin 16 is soldered to conductive layer 14 at a corner of device 10. Mounting pin 16 is preferably made of brass, but other materials can be used as well. Mounting pin 16 is mounted so that it is placed at a 45° angle to each of the axes on which piezoelectric crystals 12 are mounted.

A cable 20 is soldered to device 10. Cable 20 is a small, low capacitance, thin cable. The center conductor 17 of cable 20 is soldered to cube 11, while the ground shield of cable 20 is soldered to substrate 14.

To mount device 10, pin 16 is placed in a hole in a musical instrument 19. The proper placement of device 10 is essential to optimize the quality of sound transmitted. However, the configuration of device 10 is much more forgiving than previous devices, so more "sweet spots" exist on instrument 19 for placement of device 10.

Figure 3:
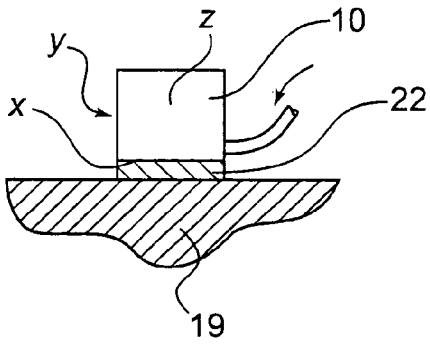
FIG. 3 shows a side view of an alternative embodiment of the device.
Figure 4:
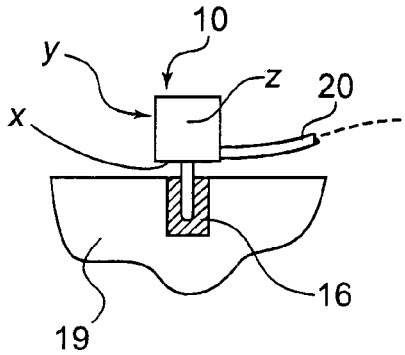
FIG. 4 shows a side view of another alternative embodiment of the device.

FIGS. 3 and 4 show alternative embodiments of the device. In FIG. 3, device 10 is mounted directly to instrument 19 via adhesive, so that the contact point is parallel to the body of the device. No mounting pin is used. In FIG. 4, mounting pin 16 is connected directly to one of the faces of device 10 so that mounting pin 16 is perpendicular to the face on which it is mounted.

Figure 5:
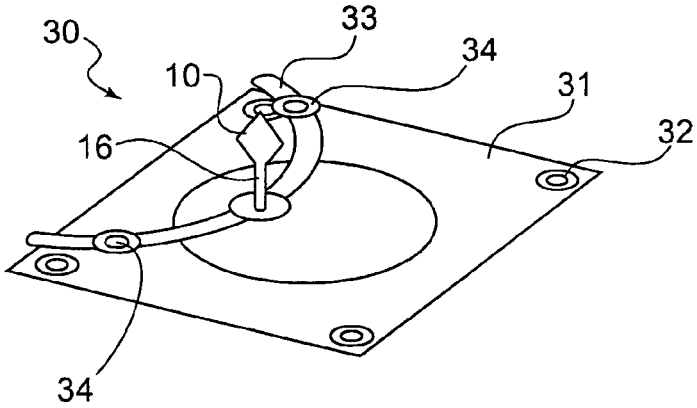
FIG. 5 is a perspective view of a mounting mechanism for use with the device.
Figure 6:
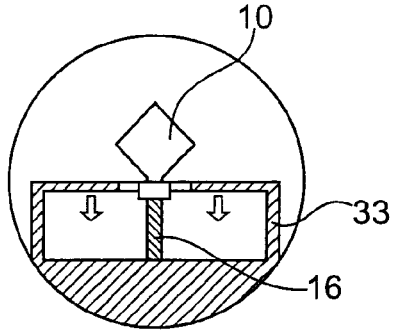
FIG. 6 is a side view of the mounting mechanism in a finished position.

If device 10 is not mounted directly to the face of the guitar via the pin or an adhesive, it can be mounted to the underside of the guitar face via a mounting bracket 30, shown in FIGS. 5 and 6. Bracket 30 comprises a mounting plate 31 to which two arms 33 are connected. Arms 33 are attached to a weight of pin 16 and extend from pin 16 to mounting plate 31 to connect device 10 to mounting bracket 30. The arms 33 apply a downward force to device 10 but do not interfere with the sound. Arms 33, device 10, pin 16 and plate 31 are all at the same acoustic potential. Mounting bracket 30 is then mounted via screws 32 to the rear surface of the front of the guitar or other instrument.

Figure 7:
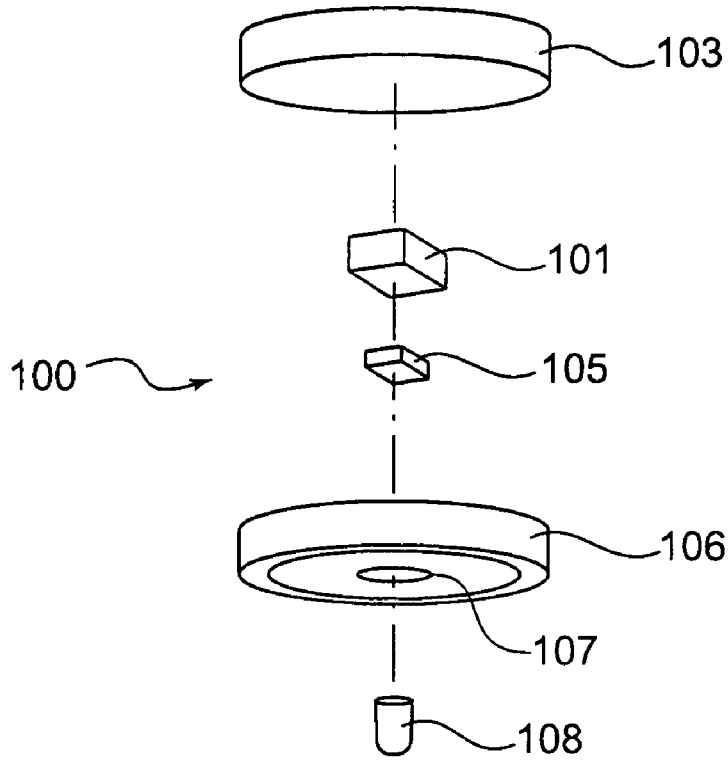
FIG. 7 is an exploded view of another alternative embodiment of the invention, using a single crystal.
Figure 8:
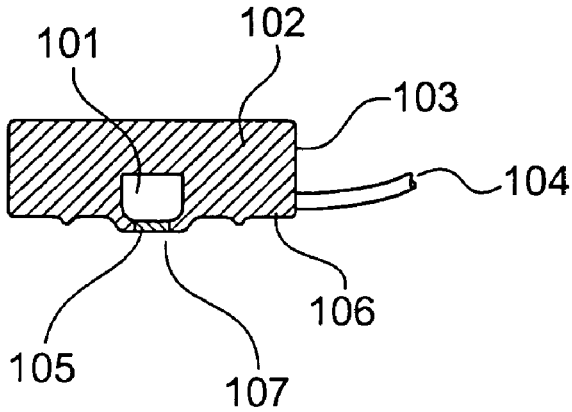
FIG. 8 is a cross-sectional view of the embodiment of FIG. 7.

FIGS. 7–8 show another alternative embodiment of the invention, in which transducer 100 has a single crystal. In this embodiment, transducer 100 is comprised of a cube-shaped weight 101 surrounded by a potting compound or gel 102, which acts as an insulator, and a conductive cover 103. A cable 104 is connected to cover 103. A piezo element 105 is attached to weight 101. A substrate 106 is disposed at a bottom surface of transducer 100. Substrate 106 has a point source contact area 107. Transducer 100 is connected to an instrument via either adhesive or a pin 108.

Figure 10:
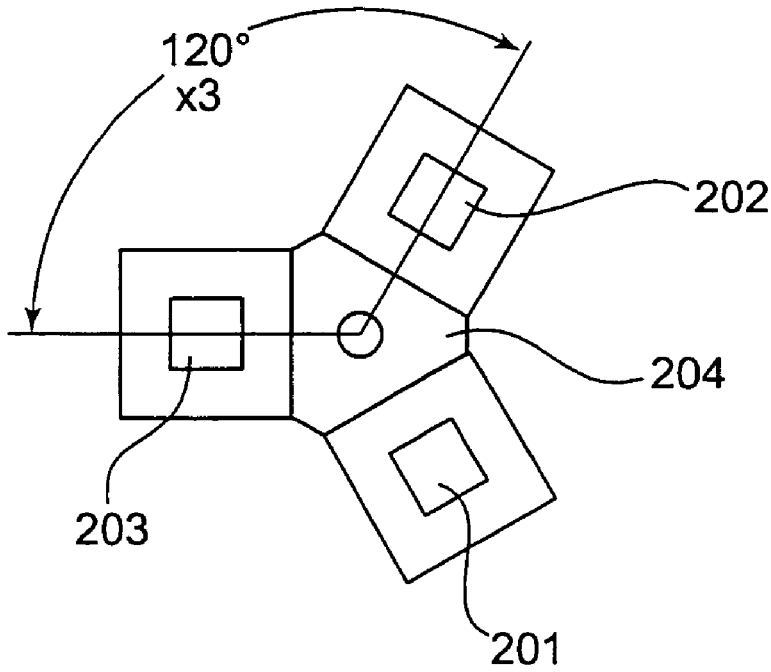
FIG. 10 is a top view of the embodiment of FIG. 10.
Figure 9:
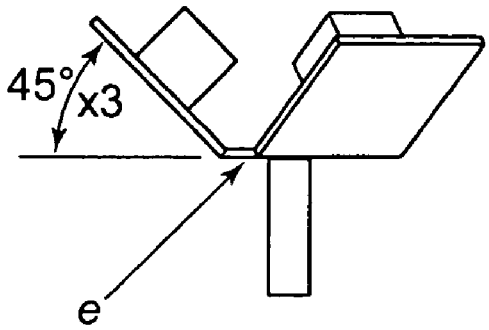
FIG. 9 is a is a perspective view of yet another embodiment of the transducer according to the invention.

FIGS. 9 and 10 show yet another alternative embodiment of the invention, in which transducer 200 has three cube-shaped weights 201, 202, 203, connected to a single Y-shaped mounting plate 204, with each weight located on a separate arm of the "Y". Each weight 201–203 contains a single sensor (not shown). Each weight 201–203 is disposed at about 120° radially from each of the neighboring weights. The arms of mounting plate 204 are bent upward at about 45° from the horizontal. Each sensor corresponds to a different axis than the sensors in the neighboring weights. For example, if the sensor of weight 203 is considered to be directed on an "x" axis, the sensor of weight 202 is directed along a "y" axis and the sensor of weight 203 is directed along a "z" axis, so that the signals picked up by the sensors do not cancel each other out. Each weight 201–203 is configured similar to device 10 in FIGS. 1 and 2, just with each weight having only a single sensor.

Figure 11:
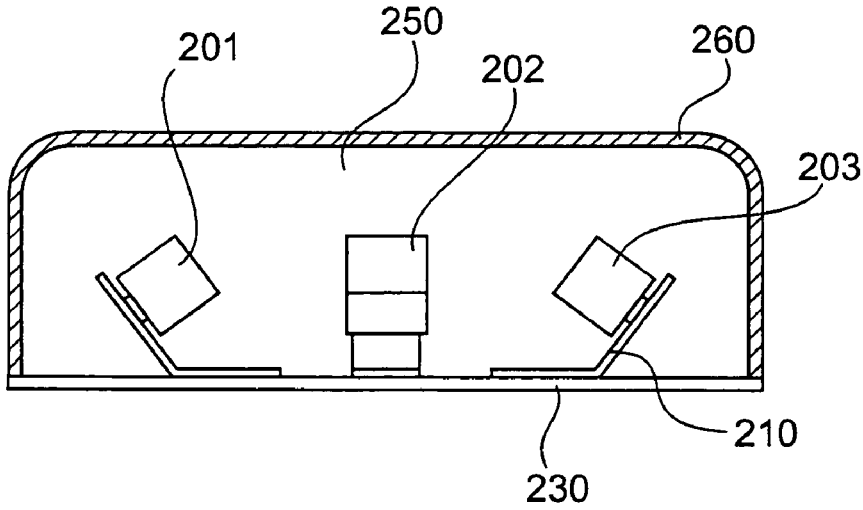
FIG. 11 is an alternative embodiment of the transducer shown in FIGS. 9 and 10.

FIG. 11 shows an alternative to the transducer of FIGS. 9 and 10. In this Figure, each of the weights 201–203 are mounted on a separate mounting plate 210, which is then connected to a substrate 230. The entire arrangement is then covered by an insulating gel 250 and a conductive cover 260. Although not shown, the embodiment of FIGS. 9 and 10 is also in practice covered by an insulating gel and cover such as that shown in FIG. 11.

Figure 12:
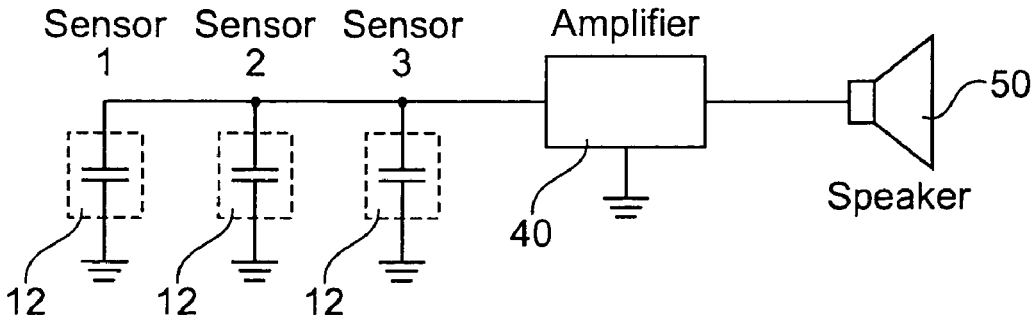
FIG. 12 is an electrical circuit diagram of the transducer arrangement according to the invention.

FIG. 12 shows an electrical circuit diagram of the sensor arrangement according to the invention. Sensors 12 are electrically connected in parallel with each other and to an amplifier 40 and then on to a speaker 50. As explained above, sensors 12 pick up vibrations from the instrument and transmit the vibrations to amplifier 40, which amplifies the sound, which is then fed to speaker 50. An identical arrangement is used for the sensors in cubes 201–203 shown in FIGS. 9 and 10.

Accordingly, while only a few embodiments of the present invention have been shown and described, it is obvious to those skilled in the art that many changes and modifications may be made thereunto without departing from the spirit and scope of the invention.

What is claimed is:

1. A transducer for use with a musical instrument to transmit vibrations from the instrument to an amplifier, said transducer comprising:

at least one sensor;

a weight connected to said at least one sensor along an axis of said weight;

an insulating layer covering the weight and said at least one sensor;

a conductive layer covering the insulating layer and having a contact surface;

an attachment device for mounting the transducer to the musical instrument via said contact surface, said attachment device adapted to contact the instrument at a single point, said attachment device extending alone an axis perpendicular to said contact surface, and said axis of said weight containing said sensor being arranged not parallel or perpendicular to said attachment device;

a conductor connected to said weight and to a signal processing device; and an additional conductor attached to said conductive layer and to said signal processing device;

wherein vibrations in said musical instrument are transmitted from said musical instrument to said at least one sensor, said at least one sensor generating a signal between the conductor connected to the conductive layer and the conductor connected to said at least one sensor in proportion to the vibrations, creating a signal that is amplified by the signal processing device.

2. The transducer according to claim 1, wherein the weight is a cube formed of a conductive metal.

3. The transducer according to claim 2, wherein there are three sensors, each sensor being mounted to the cube so that the sensors are disposed on three different axes.

4. The transducer according to claim 3, wherein the sensors are selected from the group consisting of piezoelectric crystals, piezoelectric film, magnetic sensors, strain gauge sensors, electret sensors, resistive sensors, and capacitive sensors.

5. The transducer according to claim 1, wherein the attachment device is a pin mounted to the conductive layer, said pin being attached in a symmetrical location relative to said at least one sensor on the weight.

6. The transducer according to claim 5, wherein the weight is a cube;

there are three sensors mounted on the weight at three different axes; and the pin is mounted on a corner of the conductive layer surrounding the weight such that the pin is placed at about a 135° angle to each of the sensors.

7. The transducer according to claim 1, wherein the attachment device is a contact plate.

8. The transducer according to claim 1, wherein the attachment device is a raised area of sound conductive material.

9. The transducer according to claim 1, wherein the attachment device is a fastener adapted to attach the weight directly to the musical instrument.

10. The transducer according to claim 1, wherein there are three weights connected to a connecting plate, each weight carrying a single sensor, and wherein each weight is disposed radially symmetric to said other weights about a center point defined by said attachment device.

11. The transducer according to claim 10, wherein said connecting plate has three arms, each arm connected to one of the sensors, and wherein each arm is bent upward from horizontal by an angle of about 45°.

12. The transducer according to claim 11, wherein the attachment device comprises a pin mounted in a center of the connecting plate on a bottom surface of the connecting plate.

13. The transducer according to claim 1, wherein the attachment device comprises a bracket comprising:

a mounting plate;

one or more arms connected to said mounting plate;

a pin connected to the transducer and to said arms at a weight of said pin;

wherein said mounting bracket is adapted to be mounted to an instrument via fasteners or adhesives.

14. A transducing device adapted to be attached to a musical instrument, comprising;

at least two sensors, at least one weight connected to at least one of said at least two sensors, each of said sensors being connected to a different axis of said weight;

an insulating layer covering the at least one weight and said at least two sensors;

a conductive cover layer covering the insulating layer and having a contact surface;

an attachment device for mounting the transducer to the musical instrument via said contact surface, wherein said attachment device extends along an axis perpendicular to said contact surface, and each of said axes of said weights containing said sensors being disposed not parallel or perpendicular to said attachment device;

a conductor connected to said at least one weight and to a signal processing device; and an additional conductor attached to said conductive layer and to said signal processing device;

wherein vibrations in said musical instrument are transmitted from said musical instrument to said at least two sensors, said at least two sensors independently generating a signal between the conductor connected to the substrate layer and the conductor connected to said sensors in proportion so the vibrations create a signal that is amplified by the signal processing device.

15. A device as in claim 14, wherein there are three weights, with a sensor on each of said weights, said weights and sensors being disposed not parallel to each other.

16. A device as in claim 15, wherein said weight is a cube, creating a cube-shaped transducer, and wherein said contact surface is located on a corner of said transducer on said conductive layer, wherein a principal long diagonal between said corner and an opposing corner is oriented perpendicular to the surface of said musical instrument, and wherein said sensors are located on three sides of said cube proximate to a surface of said musical instrument, and wherein each of said sensors is centered on said proximate sides.

17. A device as in claim 14, wherein the sensors are selected from the group consisting of piezoelectric crystals, piezoelectric film, magnetic sensors, strain gauge sensors, electrical sensors, resistive sensors and capacitive sensors.

18. The device according to claim 14, wherein said contact surface is a flat plate and wherein there are three weights, each with a single sensor on each weight, and wherein each weight is affixed to an additional plate that is connected symmetrically to the contact surface, each flat plates affixed symmetrically to said contact surface and extending upward and away from said contact surface, and wherein said sensors are arranged not parallel to each other.

19. The device according to claim 18, wherein said additional plates are bent upward from a plane of said contact surface by an angle of 45 degrees, forming orthogonal planes relative to each other.

20. A method for creating a point source contact transducer for detecting surface vibrations and transmitting said vibrations from a musical instrument to one or more sensors, said sensors generating a final output signal that has natural tonal qualities of said instrument, comprising the steps of:

forming a transducer having a conductive substrate, connecting said substrate to at least one sensor symmetric to a normal axis of the substrate;

connecting said at least one sensor to at least one weight, with said at least one sensor being disposed on an axis of said weight;

covering the substrate, sensor, and weight with an insulating layer or air gap;

covering said insulating layer or air gap with a conductive layer shielding the transducer from external EMI interference by connecting the conductive layer to the substrate;

connecting a coaxial cable center conductor of a coaxial cable to said at least one weight;

connecting a coaxial cable shield of the coaxial cable to the substrate to form a reference ground of the transducer;

forming a single point contact area on the transducer;

placing the transducer via said single point contact area on a surface of the instrument, wherein said axis of said weight containing the sensor is not parallel or perpendicular to said surface of said instrument;

detecting surface vibrations of the instrument via said at least one sensor through the single point contact area; and transmitting the vibrations to an amplifier through the coaxial cable.

21. The method according to claim 20, wherein there are at least two sensors, and further comprising the steps of:

placing the sensors on the substrate such that the sensors are placed radially symmetric to the single point contact area;

connecting said at least two sensors electrically in parallel; and proportionally summing outputs of said sensors, and converting said outputs to a sum signal to obtain a true representative of natural tonal qualities of said instrument.

* * * * *